United States Patent [19]

Cornell

[11] 4,345,392

[45] Aug. 24, 1982

[54] CALENDAR

[76] Inventor: Robert W. Cornell, 40 Belknap Rd., West Hartford, Conn. 06117

[21] Appl. No.: 184,749

[22] Filed: Sep. 8, 1980

Related U.S. Application Data

[63] Continuation of Ser. No. 951,745, Oct. 16, 1978, abandoned.

[51] Int. Cl.[3] ..... G09D 3/10; G09D 3/04; G09F 11/18

[52] U.S. Cl. ..... 40/116; 40/121; 40/514

[58] Field of Search ..... 40/116, 117, 120, 107, 40/385, 386, 387, 514, 515, 516, 517, 341

[56] References Cited

U.S. PATENT DOCUMENTS

| | | | |
|---|---|---|---|
| 207,675 | 9/1878 | Peck | 40/116 |
| 288,329 | 11/1883 | Hack | 40/116 |
| 495,980 | 4/1893 | Lazaron | 40/116 |
| 511,031 | 12/1893 | Stuart et al. | 40/116 |
| 1,310,905 | 7/1919 | Cook | 40/117 |
| 1,320,918 | 11/1919 | Reyer | 40/514 |
| 1,385,140 | 7/1921 | Martin | 40/116 |
| 1,430,112 | 9/1922 | Peffly | 40/116 |
| 1,840,179 | 1/1932 | White et al. | 40/117 |
| 2,070,486 | 2/1937 | Leyen | 40/514 |
| 2,258,525 | 10/1941 | Vigurs | 40/514 |
| 3,432,952 | 3/1969 | Pratt | 40/117 |
| 3,609,897 | 10/1971 | Bartlett | 40/116 |

FOREIGN PATENT DOCUMENTS

| | | | |
|---|---|---|---|
| 852506 | 2/1940 | France | 40/514 |
| 199256 | 6/1923 | United Kingdom | 40/116 |

*Primary Examiner*—Gene Mancene
*Assistant Examiner*—Michael J. Foycik
*Attorney, Agent, or Firm*—Norman Friedland

[57] ABSTRACT

This invention relates to a simple, inexpensive calendar sheet and holder, intended as an appointment type where notations may be made in each day box, that has as its feature a continuous week by week display covering several, say 5, weeks at a time. Preferably one plus calendar years are printed on a continuous roll of paper so that as each week ends it is pulled so that successive weeks, one per line, are exposed and the used portion may be torn-off. The flat calendar holder is of simple, preferably one piece, construction, which has a unitary chamber to hold the calendar roll and an aperture to expose the calendar sheet.

3 Claims, 7 Drawing Figures

FIG. 1
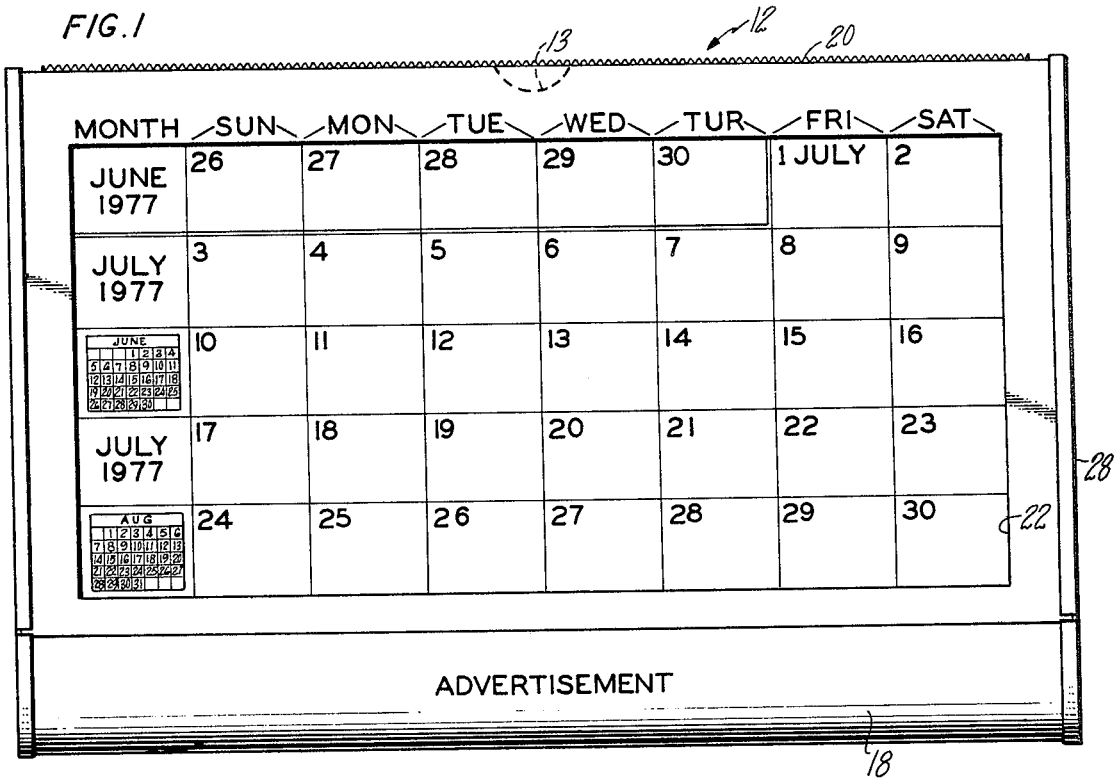
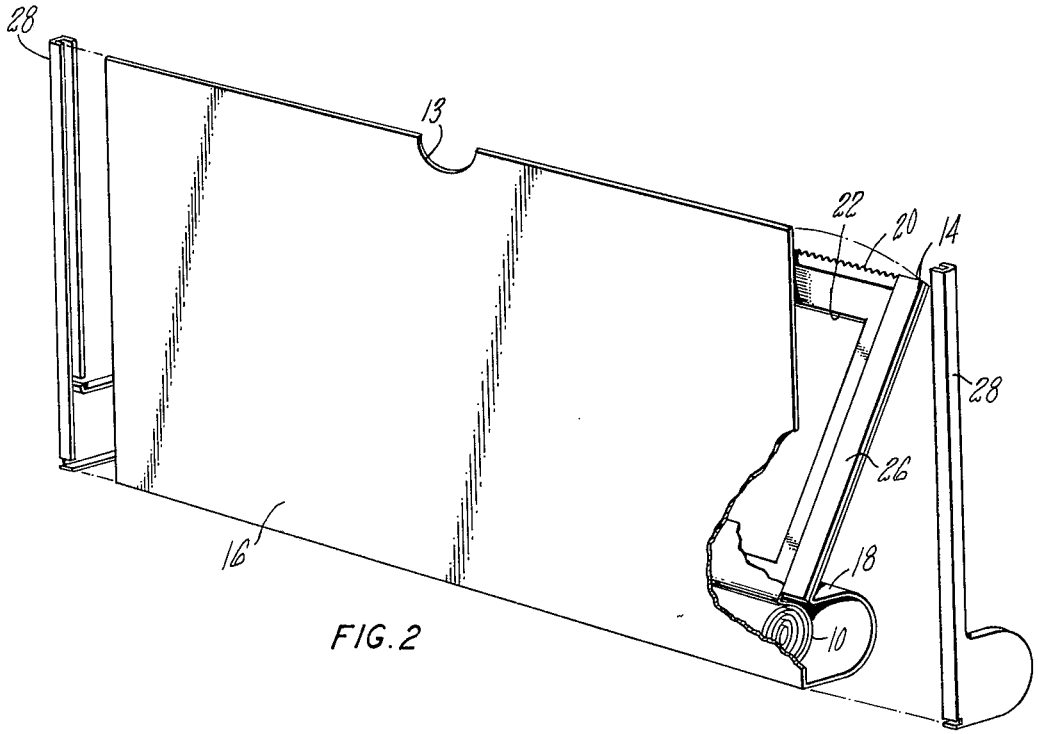
FIG. 2

CALENDAR

This is a continuation of application Ser. No. 951,745 filed Oct. 16, 1976 now abandoned.

DESCRIPTION

1. Technical Field

This invention relates to a flat, simple, inexpensive continuous type calendar intended as an appointment type where notations may be made in each day box, that has as its feature a continuous week by week display covering several, say five, weeks at a time. Preferably one plus calendar years are printed on a flexible, continuous calendar sheet of paper so that as each week ends, the calendar sheet may be advanced to expose successive weeks, one per line, and the used portion may be torn off. The flat calendar holder is of simple, preferably one piece, construction which has a unitary chamber to hold the rolled up portion of the calendar sheet and an aperature to expose the calendar sheet for viewing and making notations.

2. Background Art

As is well known there are a multitude of calendars utilized as appointment types. Typically business calendars include a page for each day, or a page for each month and upon the day or month expiring the page is removed, destroying the continuity for the viewer. Hence, the time following the exposed days or month, as the case may be, is hidden from view and is a source of inconvenience. Single month calendars often have overlapping days making it difficult to note appointments.

In this light, I have obviated these problems by providing a calendar combined with a single, inexpensive holder that continuously exposes the days of the week for a given successive number of weeks regardless of what month it may fall in. That is to say, the weeks of successive months will be exposed as the calendar is used up. It is contemplated that the calendar year plus will be printed on a roll and stored in a unitary chamber of the holder. As it is unrolled within the flat holder, in its preferred form, five successive weeks; will expose in the holder's aperture—the present and the subsequent four. As the weeks are used up, they are advanced and torn away using the edge of the holder. Hence, the calendar always has a clean look and exposes at least four additional weeks for noting appointments.

DISCLOSURE OF INVENTION

An object of this invention is to provide an improved, simple inexpensive calendar sheet and holder, the former being printed on paper that is rolled and stored in the unitary chamber of the holder as being unrolled within the flat holder so that successive weeks are exposed in the aperture of the holder. Each printed line would be one week in length plus an eighth space for other calendar information such as the month, year and small calendars of future and past months. As the week is completed, the paper is pulled and the subsequent week becomes exposed and the expired week is torn-off. Five weeks (more or less) are always in view.

The simple, flat holder of the calendar consists of one to four parts. Its primary part is formed to have a chamber to hold the calendar roll, an edge for tearing the calendar, names of the days of the week and the word month embossed along the edge of the cutout for the calendar, a cutout to expose the calendar for viewing and noting engagements, and tight edges to hold the calendar in place.

BRIEF DESCRIPTION OF THE DRAWINGS

FIG. 1 is a plan view of the invention.

FIG. 2 is a perspective view in exploded form viewed from the underneath side.

BEST MODE FOR CARRYING OUT THE INVENTION

Figure 5:
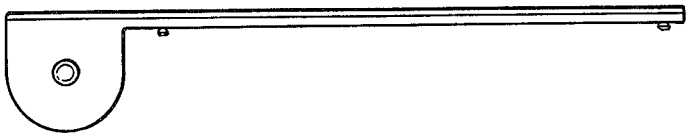
FIG. 5 is an end view of FIG. 3.

The term "continuous calendar" as used in the context of this invention is not to be confused with a class of calendars that are known in the industry as perpetual calendars. It is not a feature of this calendar that it is not depleted as the weeks expire as would be the case of a perpetual calendar. The calendar of this invention expires in the same sense that the typical commercial yearly calendar is exhausted. Continuous in the sense used herein is that successive weeks are continuously exposed until the calendar sheet is used up, be it one or more years, depending on the number of years printed on the roll.

As can be seen by referring to FIGS. 1 and 2 the calendar sheet is printed on paper in roll form as generally indicated by numeral 10 and is contained in its holder 12 having a top 14 and a bottom 16 which may be fabricated in one piece from cardboard, plastic, metal, or any suitable material. In this instance the bottom contains a unitary curved portion 18 forming a chamber for receiving the calendar roll. The end of the roll is passed between the flat top 14 and flat bottom 16 and extends to the end 20 so that the indicia is viewed through the aperture 22 formed in the top 14. End 20, which in this view is on the top 14, may similarly be located on the bottom and carries a cutting, preferably serrated, edge. Depending on the thickness of the calendar paper, a recess 26 on the side edge may be either formed integral with the top 14 or suitably attached thereto to serve as a spacer providing sufficient room between the bottom and top to permit the calender sheet to pass snugly. Optionally, end caps having deep lips forming channels overlap the side edges and frictionally hold the bottom and top together. Recess 13 serves to allow the user to grip the paper to advance it.

As noted, the calendar weeks are arranged so that each week forms a single horizontal line, notwithstanding the fact that a day of a week may end in a month other than at the last vertical column and the next subsequent day of the next month appears. In the preferred embodiment there are five horizontal rows in view at all times representing a complete week for each row. Each row is divided into eight columns, seven of which correspond to the seven days of the week. The additional vertical column, say the first, is included at the left to indicate the month in which the week, or a portion thereof falls and to include small monthly calendars of future and past months for reference purposes. For example, in the months illustrated, June 26–30 (Sunday through Thursday) are in the top horizontal column and July 1 and 2 (Friday and Saturday) make up the remaining days of the complete week. The four future weeks of July up to the 30th of the month equally apportioned follow. Obviously, the remaining weeks of the calendar are similarly printed, so that as the week expires, the user will pull the end upwardly in this embodiment until that week is out of view and the next successive week, including July 31 and August 1 to 6 is exposed. Hence, there will be exposed, the current week and the next succeeding four weeks at all times. Of course, the user has several options on how he may use the calendar, as say, he may want to keep a past, present and future week exposed at all times. Because of its continuous form, all days are separate, whereas as conventional monthly calendars frequently have overlapping days. For example, the usual monthly calendar for July 1977 would have both July 24 and 31 in the same block under Sunday of FIG. 1, whereas in the embodiment herein no such overlapping occurs.

Figure 4:
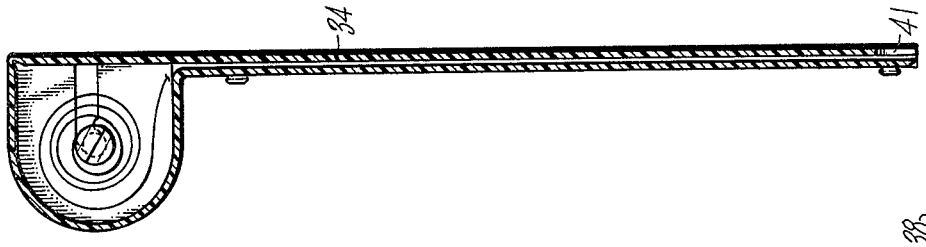
FIG. 4 is an enlarged sectional view taken along line 4—4 of FIG. 3.
Figure 3:
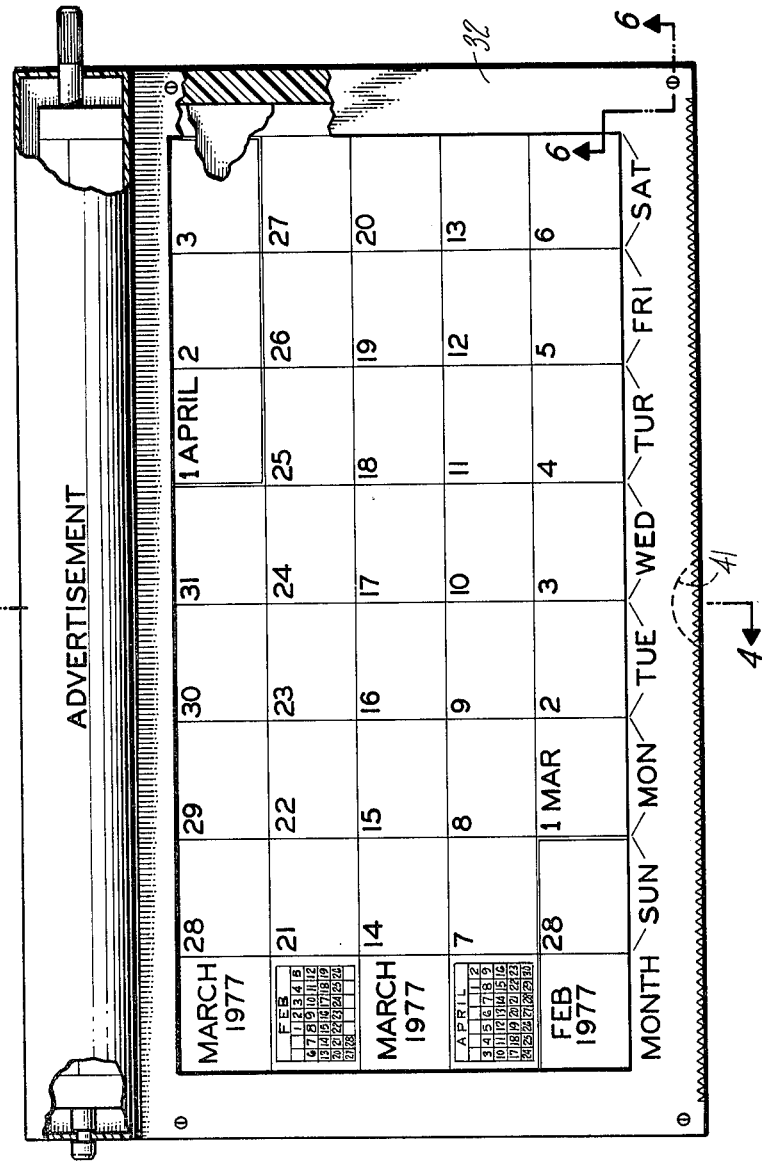
FIG. 3 is a plan view showing another embodiment of this invention.
Figure 6:
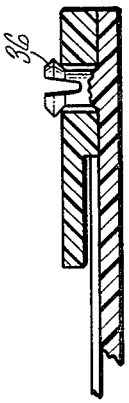
FIG. 6 is a partial view in section taken along line 6—6 of FIG. 4.
Figure 7:
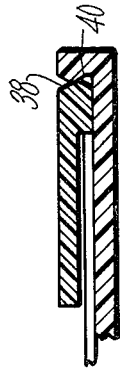
FIG. 7 is a partial view taken along the same section as FIG. 6 showing another construction detail.

FIGS. 3 to 7 inclusive show another embodiment of a holder adapted for the calendar roll. The calendar roll of paper can be mounted on a shaft 30 serving to permit the user to rewind the roll, which he may desire, say in the event he wishes to note an appointment more than five weeks in the future. The top 32 defines a molded frame like structure that is secured to the bottom 34 place by a frictional fit by either the projections 36 shown in FIG. 6 or frictional fit shown in FIG. 7 where the side edges 38 of top 32 compliment the side edges 40 of bottom 34 and snap into place and are frictionally held in place. Such embodiments circumvent the need for separate side pieces 28. Recess 41 serves to allow the user to grip the paper for advancing it.

Having described the invention, the following claims are:

1. A flat, continuous, appointment calendar essentially consisting of a one-piece support holder having a flat bottom with a finger recess, a flat frame-like top having a top edge, bottom edge, and two side edges and overlying said flat bottom and spaced to accommodate sliding of a flexible continuous calendar sheet having calendar indicia thereon, and one-piece support also having a curved enclosure defined section connecting the top and bottom to form a chamber to hold the rolled up portion of the continuous calendar sheet, a unitary attachment means holding the top and bottom together along the side edges, an aperture defined by said frame-like top flat member to gain access to the calendar sheet so as to permit writing thereon, and the names of the days of the week and the word "month" printed or embossed on the holder along the top or bottom edge of the aperture, and a flexible, continuous calendar sheet having calendar indicia printed thereon, said indicia being divided in rows indicating the month or giving other month information and the days of the month, and in columns indicating month information and the days of the week, the columns arranged so that each day will be separately defined in each row even when the months change so that pulling the row out of view of the aperture will expose at least more than one future week, and weekly rows being detachable from the calendary sheet without affecting the succeeding weekly rows.

2. A calendar as in claim 1 including two separate edge pieces to hold together the top and bottom of the one-piece holder in place of the said unitary attachment means.

3. A calendar as in claim 2 including a spindle for holding the calendar sheet roll and extending from the curved enclosure and adapted to wind the calendar sheet.

* * * * *